US010315098B2

(12) United States Patent
Nobil

(10) Patent No.: US 10,315,098 B2
(45) Date of Patent: Jun. 11, 2019

(54) ACCESSORY TRACTION DEVICE FOR SKIS

(71) Applicant: John B. Nobil, La Jolla, CA (US)

(72) Inventor: John B. Nobil, La Jolla, CA (US)

( * ) Notice: Subject to any disclaimer, the term of this patent is extended or adjusted under 35 U.S.C. 154(b) by 0 days.

(21) Appl. No.: 15/694,916

(22) Filed: Sep. 4, 2017

(65) Prior Publication Data

US 2018/0078844 A1 Mar. 22, 2018

(51) Int. Cl.

| | |
|---|---|
| ***A63C 7/00*** | (2006.01) |
| ***A63C 7/04*** | (2006.01) |
| ***A63C 7/08*** | (2006.01) |
| ***A63C 7/06*** | (2006.01) |

(52) U.S. Cl.

CPC ..... *A63C 7/08* (2013.01); *A63C 7/04* (2013.01); *A63C 7/06* (2013.01)

(58) Field of Classification Search

CPC .... A63C 7/00; A63C 7/02; A63C 7/04; A63C 7/06; A63C 7/08; A63C 5/04; A63C 5/044; A63C 5/0428

See application file for complete search history.

(56) References Cited

U.S. PATENT DOCUMENTS

| | | | | | |
|---|---|---|---|---|---|
| 1,783,833 | A * | 12/1930 | Elsner | A63C 7/02 | 280/604 |
| 1,989,377 | A * | 1/1935 | Osborn | A63C 7/02 | 280/604 |
| 2,150,988 | A * | 3/1939 | Russell | A63C 7/02 | 138/156 |
| 2,287,252 | A * | 6/1942 | Kaufmann | A63C 7/02 | 280/604 |
| 2,322,497 | A * | 6/1943 | Weinaug | A63C 7/08 | 280/604 |
| 2,358,213 | A * | 9/1944 | Courage | A63C 7/08 | 280/604 |
| 3,063,728 | A * | 11/1962 | Patterson | A63C 5/0485 | 280/608 |
| 4,006,912 | A * | 2/1977 | Perlich | A63C 5/062 | 280/809 |

(Continued)

FOREIGN PATENT DOCUMENTS

| | | | | |
|---|---|---|---|---|
| AT | 12128 U1 * | 11/2011 | A63C 7/08 | |
| EP | 2695646 B1 * | 3/2017 | A63C 7/02 | |

(Continued)

OTHER PUBLICATIONS

Irwin Tools Quick-Grip Replacement pads, Amazon.com internet advertisement dated Mar. 30, 2015.*

*Primary Examiner* — James A Shriver, II
*Assistant Examiner* — Steve Clemmons
(74) *Attorney, Agent, or Firm* — Timothy W. Fitzwilliam

(57) ABSTRACT

An accessory traction device removably attached to undersides of backcountry skis is described herein. The device will provide users' ability to ascend terrain without removing skis and walking uphill. As designed, the device has novel structure with flanged or clamping ends with a threaded fastening rod that improves longevity while minimizing any possible damage to the ski itself. The traction wave patterns and grooves are also optimally designed and tapered. An additional inventive aspect involves a few hinge options wherein the hinge allows the device to be conveniently folding and stowed in a backcountry skier's backpack.

3 Claims, 6 Drawing Sheets

(56) References Cited

U.S. PATENT DOCUMENTS 4,118,050 A * 10/1978 Schnurrenberger . A63C 5/0428 280/604
4,147,377 A * 4/1979 Plenk ..... A63C 5/0411 280/604
4,178,012 A * 12/1979 Roth ..... A63C 5/0428 280/604
4,262,925 A * 4/1981 Plenk ..... A63C 5/0411 280/604
4,288,092 A * 9/1981 Mukri ..... A63C 5/04 280/605
4,398,746 A * 8/1983 Heintz ..... A63C 7/00 280/604
4,649,975 A * 3/1987 Kogure ..... B60C 11/12 152/209.22
4,777,738 A * 10/1988 Giese ..... A43B 5/08 36/116
4,910,887 A * 3/1990 Turner ..... A43B 3/0078 36/114
5,328,200 A * 7/1994 Pelizzari ..... A63C 5/0422 280/28
5,591,280 A * 1/1997 Asano ..... B60C 11/0302 152/209.22
5,664,808 A * 9/1997 Whidden ..... A63C 11/02 150/154
7,758,061 B2 * 7/2010 Staudinger ..... A63C 7/06 280/608
8,474,853 B2 7/2013 Rogers et al.
8,590,936 B2 * 11/2013 Payson ..... A63C 7/08 280/605
9,010,797 B2 4/2015 Elliott
9,656,151 B2 * 5/2017 Gasparro ..... A63C 7/02
9,895,595 B2 * 2/2018 Sæteren ..... A63C 7/02
2005/0003146 A1 * 1/2005 Spath ..... A63C 5/04 428/105
2016/0045813 A1 * 2/2016 Mayrhofer ..... A63C 7/02 280/604
2017/0202302 A1 * 7/2017 Hull ..... A43B 13/14
2017/0232800 A1 * 8/2017 Kanematsu ..... B60C 11/04 152/209.18

FOREIGN PATENT DOCUMENTS

FR 223054 A2 * 10/1974 ..... A63C 7/04
FR 2301274 A1 * 9/1976 ..... A63C 5/0428
FR 2401674 A1 * 3/1979 ..... A63C 7/04
FR 2655555 A1 * 6/1991 ..... A63C 5/035
GB 2224448 A * 5/1990 ..... A63C 7/08
WO WO-0044452 A1 * 8/2000 ..... A63C 7/06
WO WO-0117397 A1 * 3/2001 ..... A63C 5/0422

* cited by examiner

ACCESSORY TRACTION DEVICE FOR SKIS

BACKGROUND OF THE INVENTION

Field of the Invention

The present invention pertains generally to accessories removably attached to snow skis. More particularly, the invention relates to a traction device employed to a bottom of a ski for ascending a slope for use by a backcountry skier.

Description of the Prior Art

Backcountry skiing is increasingly alluring due to potentially finding pristine snow conditions and generally the adventure high of exploring where few have ever been before. One unique aspect of this effort, as compared to typical resort alpine skiing is the desire to ascend a slope without the use of ski lifts, snowmobiles, or helicopters. And, while taking skis off and walking uphill is always a viable option with some mountainous terrain; it is most often beneficial to ascend a slope much like a cross-country skier, however, employing a traction device to the bottom of the ski and, with reciprocating locomotion of arms and legs (and of course with downhill ski bindings) and not employing cross-country ski bindings. The traction device is comparable to a cross country skier with alpine ski bindings and alpine-type skis.

Previously, early tractions devices were made of seal skin and because of this, traction devices comprised of man-made materials may still be referred to as "skins." Typically, the skins have a surface that allows sliding forward but grips in the reverse direction; similar to canine fur that can only be stroked in one direction.

By far, the greatest challenge to the traction device is how to affix the device to a bottom of a ski. Heretofore, this is achieved by either glue or mechanical means, or both. A major disadvantage to glue is that it may lose efficacy in cold or wet conditions, or it may be prone to fouling by debris, if removed and re-attached frequently. A comparable obstacle with mechanical attachments is that skis have ridged, sharp edges that are difficult to negotiate without damage to the ski or attachment device itself.

Further heretofore, the field of traction devices and their attachment does not appear to be a crowded prior art group. In any event, two previous, but relatively recent examples were proposed by Rogers et al., entitled "Apparatus for Attaching Climbing Skins," U.S. Pat. No. 8,474,853, and Elliott, entitled "Climbing Skin Plates," U.S. Pat. No. 9,010,797. Both patents are heavily concerned with the difficulty of attaching a device to a bottom of a ski and the numerous problems encountered because of the harsh environment or longevity of a particular design/solution.

In addition to solutions for effective attachment, the present invention further provides optimum design materials to various components such as cables and edges of the device.

Also in light of the above, it is an object of the present invention to devise a system and method that is useful for attaching various traction designs using a unique clamping system. It is additionally an object of the present invention to provide a means for attachment that configures under the ski or on the side of the ski. Yet further, the present invention seeks to provide snow specific and terrain specific solutions employing varied traction gripping protrusions with multiple geometries providing optimum grip to glide ratio. Still further, it is an object of the present invention to provide a device having deployed and stowed positions, the latter for easily fitting into a back pack.

BRIEF SUMMARY OF THE INVENTION

The present invention specifically addresses alleviates the above-mentioned deficiencies associated with the prior art. More particularly, the present invention, in a first aspect a traction device for a ski comprising: an elongated body about a longitudinal axis, configurable to a bottom of a ski; and an attachment mechanism for coupling the elongated body to the ski, the attachment mechanism comprising: a right clamp (alternatively could be a flange) portion configured to a right edge of the ski; a left clamp (alternatively could be a flange) portion configured to a left edge of the ski; and a fastening rod having threads connected between the left and right clamp portions.

The traction device configurable to a bottom of a ski in this first aspect of the invention is additionally characterized in that it comprises: a protruding ridge configured to the right clamp portion for mating to a slanted surface of the edge; and a replaceable wear insert made of a different material than the right clamp portion and configured between the right clamp portion and the edge of the ski.

This invention in a second aspect is characterized as including: an elongated body about a longitudinal axis, configurable to a bottom of a ski, the body having a length; and a hinge configured at a half way point along the length, the hinge providing for the elongated body to fold upon itself and conveniently fit into a backpack.

Further, the invention in the second aspect is characterized wherein the hinge is a living hinge, the living hinge being a thin portion of the traction surface as compared to elongated body; or alternatively, the hinge could comprise a left and a right articulating portions that articulate about a pin.

The traction device configurable to a bottom of a ski in the second aspect is additionally characterized wherein the hinge is a sliding hinge and wherein the pin is an adjustment pin wherein the left and the right articulating portions can translate with respect to one another, further wherein the elongated body further comprises two lengthwise strips and wherein the adjustment pin and sliding hinge provide for the two lengthwise strips to move toward one another or away from one another.

Further, the traction device configurable to a bottom of a ski in the second aspect is additionally characterized in that the elongated body further comprises a length, the length being thirty-six inches wherein the length is optimally chosen for proper traction functionality, but however such that one half of said length, eighteen inches, is sufficiently short to conveniently fit into a (typical) backpack.

In yet still a third aspect, the invention may be characterized as a traction device for a ski comprising: an elongated body about a longitudinal axis, configurable to a bottom of a ski; and a traction surface for contacting to a snow surface, the traction surface having a wave configuration in a side aspect, the wave configuration comprising a plurality of peaks and a plurality of valleys.

The invention in the third aspect is additionally characterized wherein the plurality of peaks are tapered from a higher elevation at a distal end to a lower elevation at a proximal end, the proximal end being configured toward a front of the ski and the distal end configured toward a rear of the ski.

Still further, the invention in the third aspect is characterized as comprising a plurality of notches across a top surface of the elongated body and evenly spaced throughout a length of the elongated body, the top surface of the elongated body corresponding to the traction surface contacting the snow surface. Optionally the notches are oblique in shape and/or wavy in shape and/or aligned in a straight-line perpendicular to a longitudinal axis of the ski.

Additional configurations for securing a plurality of traction strips and pad are contemplated herein. Accordingly, the invention in yet another aspect is a traction device configurable to a bottom of a ski comprising: an elongated body about a longitudinal axis, said body having a width substantially similar to a bottom of a ski; an attachment mechanism for coupling the elongated body to the ski comprising: a pair of parallel cable loops defining parallel planes; a third cable connecting the pair of parallel cable loops, the third cable defining a perpendicular plane in relation to the parallel plane; a latch portion, the latch portion comprising: a lever arm; a pin wherein the lever pivots about the pin wherein further the lever arm is configured through the third cable loop. As stated, the traction device is configurable to a bottom of a ski having a width substantially equal thereto, more particularly a width of 90 mm or 92 mm or 93 mm or 98 mm or 100 mm or 102 mm.

The invention in this aspect is additionally characterized wherein the traction device is configurable to a bottom of a ski and wherein the width comprises a flanged end having a upper slanted topside particularly slanted toward the ski thereby configured to receive the pair of cable loops, wherein further notches are provided in the flanged end to receive the pair of parallel cable loops.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 2A is a bottom view of a ski initially illustrating a first traction device of the present invention;

FIG. 2B is an enlarged view of a unique hinge of the present invention about line 2B in FIG. 2A;

FIG. 2C1 and FIG. 2C2 are enlarged views of a first and second specific tread pattern of the present invention traction device;

DESCRIPTION OF PREFERRED EMBODIMENTS

Figure 1A:
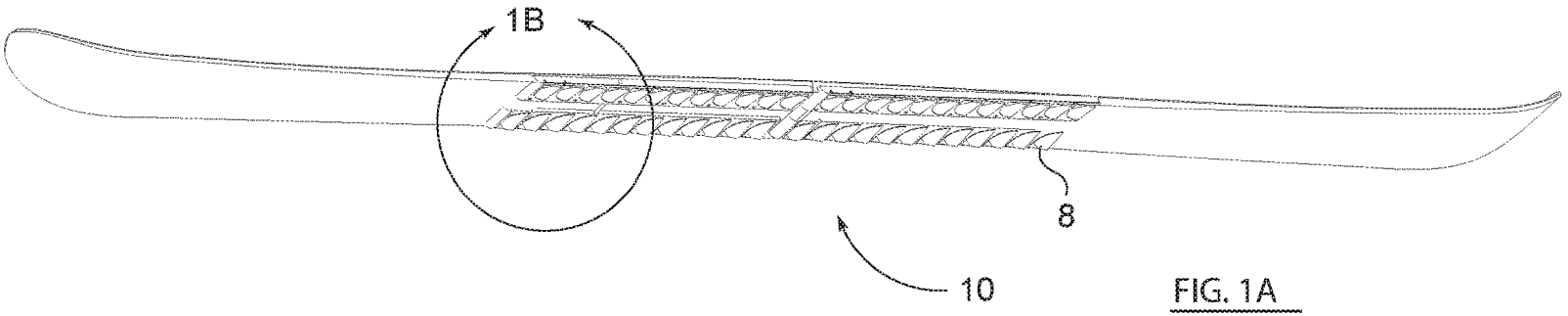
FIG. 1A is an isometric view of a first traction device embodiment having a tread pattern in a position of use in relation to a ski.
Figures 2A, 2B, 2C:
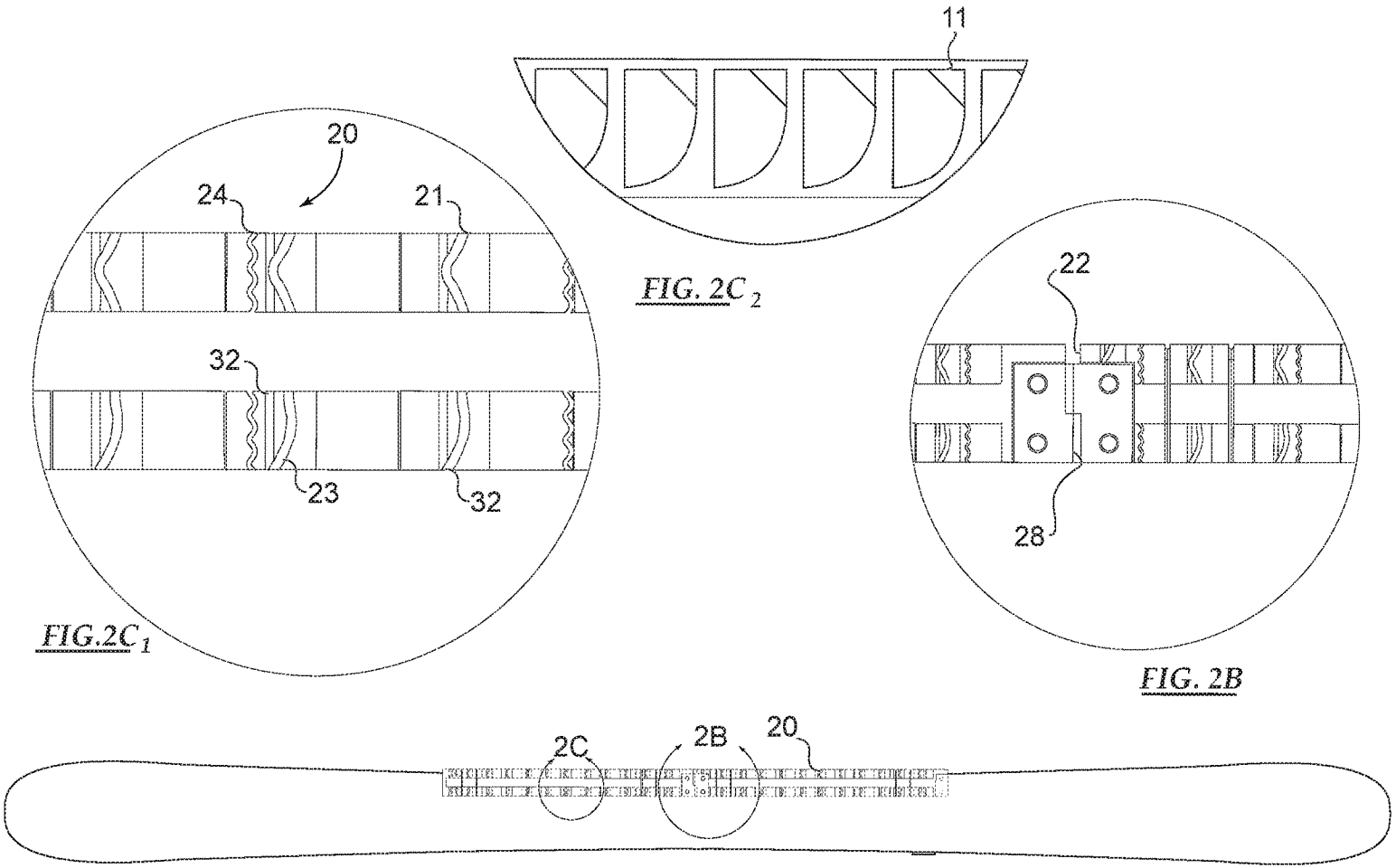

Initially with regard to FIG. 1A, a first traction device 10 with particular thread pattern 11 is illustrated in perspective configured to a top of a ski 99. The traction device 10 is elongated and substantially, but may not be entirely flat; and the ski 99 may also define an elongated axis herein. Still further, the first preferred embodiment 10 comprises left and right traction pads at respective left and right edges of a ski. Alternatively, as shown in FIG. 2A, the traction device could be two strips 20 configured toward a left or right edge of the ski. Or the invention could be two strips 20 of traction surface configured to both edges.

Figure 1B:
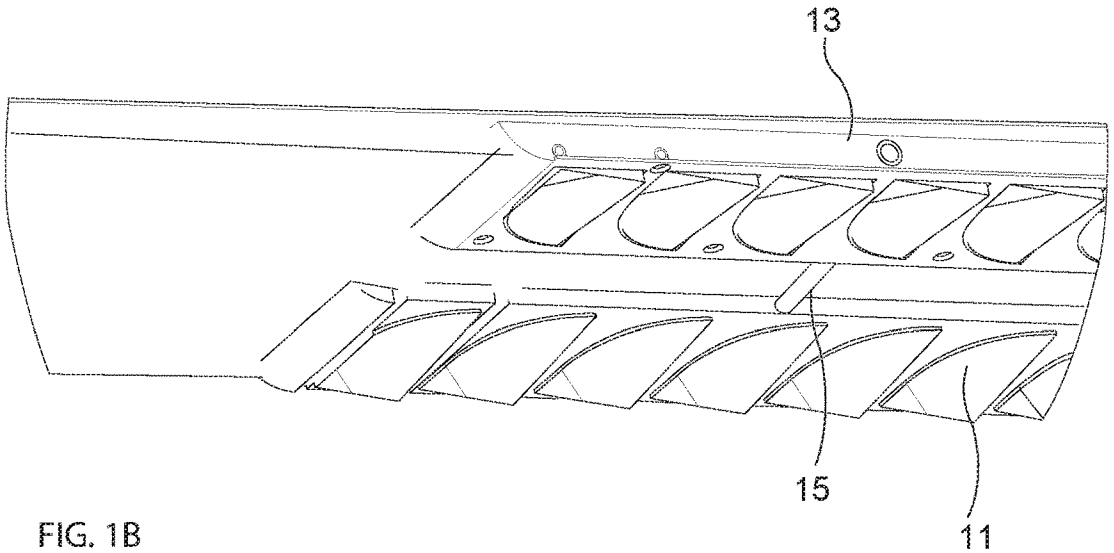
FIG. 1B is an enlarged view thereof taken about area 1B in FIG. 1A.
Figures 5A, 5B:
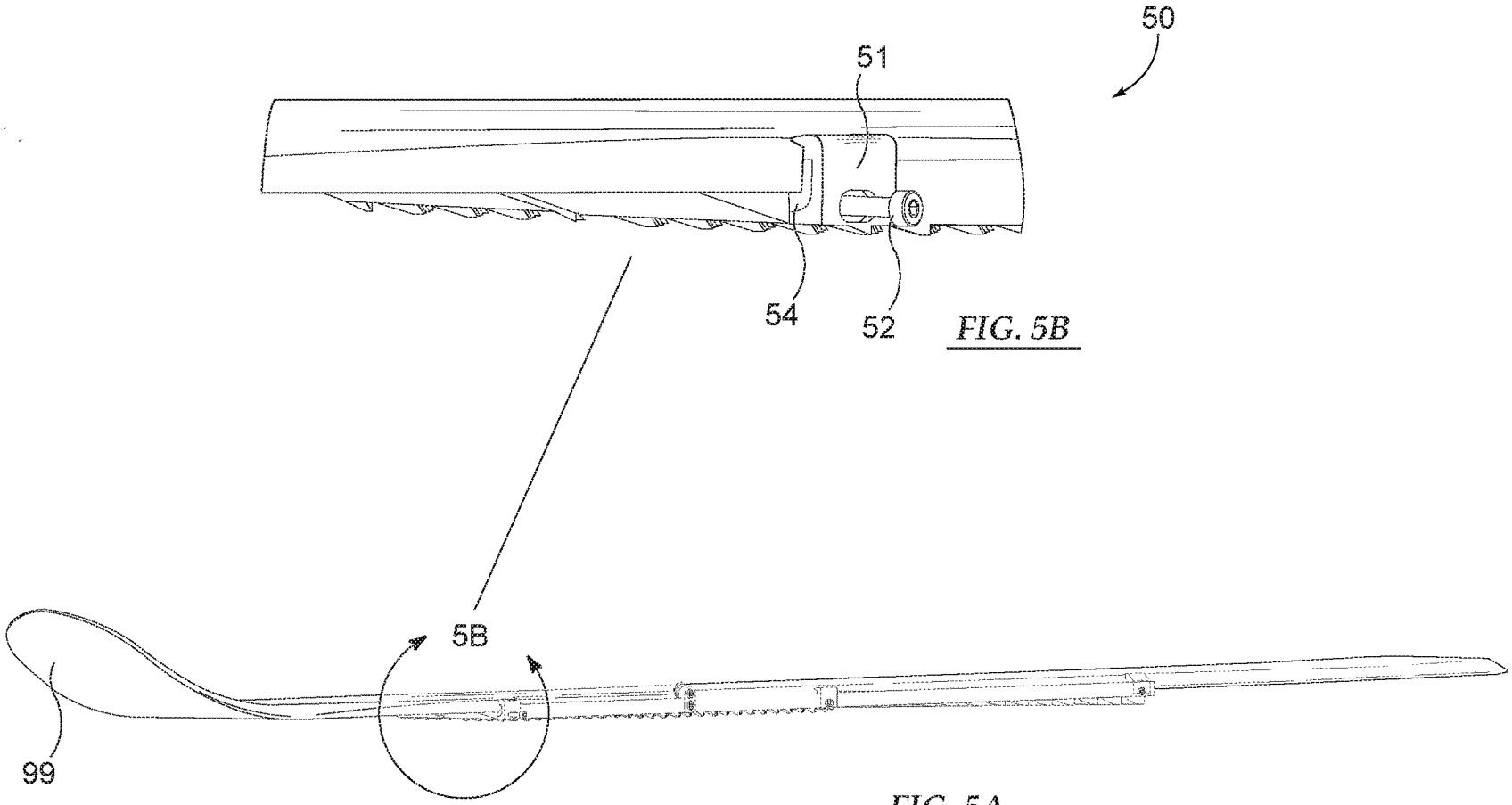
FIG. 5A is an isometric view of a clamping system of the present invention for securing a traction device to a bottom of a ski.
FIG. 5B is an enlarged view thereof taken about area 5B in FIG. 5A.

FIG. 1B illustrates an enlarged view of the first preferred embodiment 10 wherein a tread pattern comprises raised wedge portions 11 providing traction. Multiple means for securing or fastening the traction pads 10 to the bottom of the ski 99 are contemplated herein. For example, small gage cables wrapping over the top of the ski; or alternatively, a tightening rod 15, 52 (FIG. 5B) with left and right clamps 51 may be utilized.

Additionally, with regard to FIG. 1A and FIG. 1B, a flange portion 13 comprises a raised edged of the traction pad that mates to a side surface of the ski 99. The flange 13 will be import to the varied means for securing the traction devices herein to the ski. For example, low gage but strong cables can be utilized to secure the device and the flange 13 provides a surface for which to tighten the cables against. Alternatively, the flange 13 could comprise one half of a clamping mechanism with the other side flange being the other; and a threaded rod 15, 52 could be utilized to tighten each flange 13 (or clamp portion 51) toward one another.

Also importantly, with reference to FIG. 1A and FIG. 1B, the elongated traction pads are foldable about living hinge 12 to form two equal length shorter elongated halves. In the preferred embodiment, the total length of the traction pads is thirty-six inches with each half being eighteen inches. This has been found to be the optimum length for utility of the traction device 10 however still allowing it 10 to be conveniently stowed in a backpack. The stowage of the device will be very important to the advanced skier since he or she will not want to sacrifice performance on the way down the mountain with the device 10 protruding out a top of the backpack. The living hinge 12 is more specifically defined as a thin area 12 between the two eighteen-inch halves made from the same material as the halves but thin enough to allow the halves to fold about living hinge 12.

With regard to FIG. 2A, a bottom view of a ski initially illustrating a top view of a second traction device 20 of the present invention is shown. This embodiment 20 is different from the first 10 in that there are two strips per side, or just one side, instead of just one per left and/or right side of the ski. With attention to FIG. 2B, second unique hinge 22 of the present invention is further provided. A sliding hinge adjustment pin 28 is included adding versatility of coverage and different width of ski bottom and generally the ability to make slight adjustments. In other words, the hinge 22 has two articulating halves that can translate with respect to one another, which would allow two halves (lengthwise) of the traction pad to be spaced farther apart and therefore a wider coverage will be provided. The hinge 22 further provides for a segmented traction device that folds and can easily fit inside a backpack. Exemplary dimensions are two eighteen-inch halves (across-wise). To be clear, the traction pad can have two halves separated across-wise (FIG. 1A) or two halves separated lengthwise (FIG. 2A).

Figure 4A:
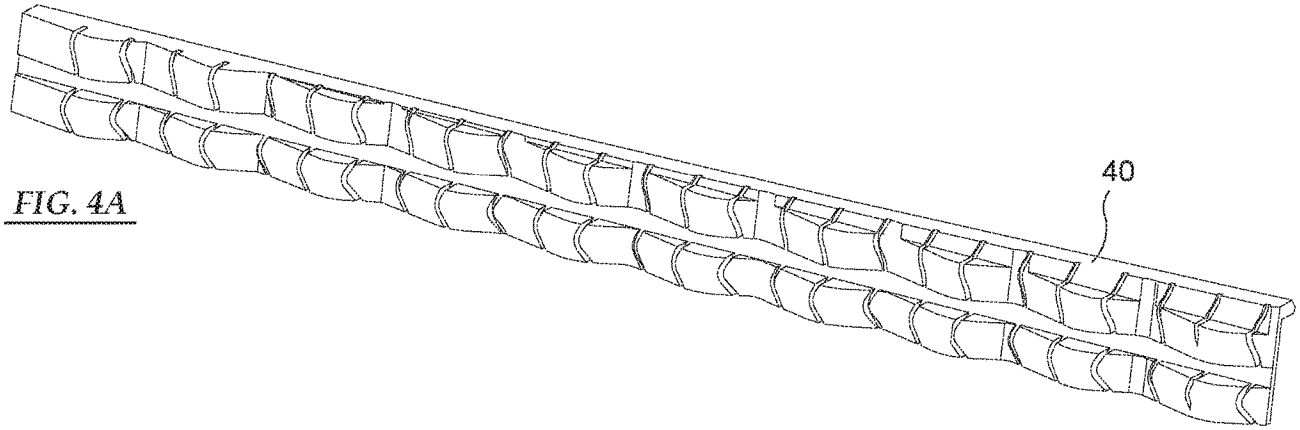
FIG. 4A is a perspective view of yet an additional thread pattern embodiment of the present invention.
Figure 4B:
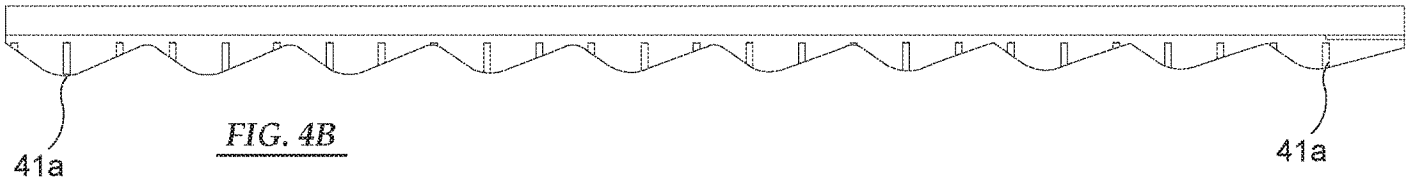
FIG. 4B is a profile view thereof.
Figure 4C:
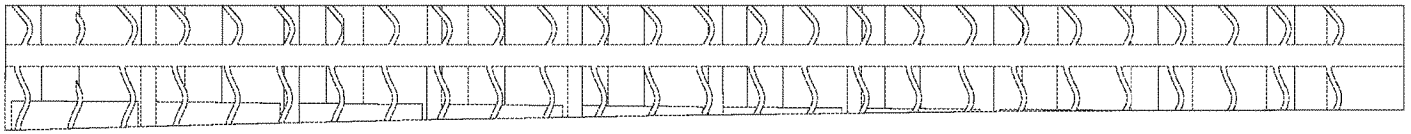
FIG. 4C is a top view thereof which would also correspond to a bottom view of a ski.

Specific tread patterns are illustrated in following views, FIG. 2C1 and FIG. 2C2. A first tread pattern has ridges channels and notches in the top aspect with some being straight lines 32 (to receive BOA® cables, for example) and others that are curved (hump or ½ sine wave 21), wavy 24 and oblique 23. The notches 32 appear as straight lines 32 in the tread pattern. FIG. 4C shows a second tread pattern 11 embodiment with wedges 11 raised at one end (therefore a slanted rise) as additionally shown in FIG. 1A and FIG. 1B.

In various embodiments 10, 20, 30, 40 herein, the traction device comprises a rigid exoskeleton comprised of titanium and a carbon fiber about and surrounding the exoskeleton. Accordingly, portions that receive the most wear are reinforced exoskeleton. Also optionally, edges of the traction device are specifically designed to provide traction past a point where the actual tread gives up. Hence, the present invention provides much greater longevity than prior art skins. Edges at the width of the traction device 10, 20, 30 40, are designed and treated to provide side hill traction useful in tight mountain situations.

Figure 3A:
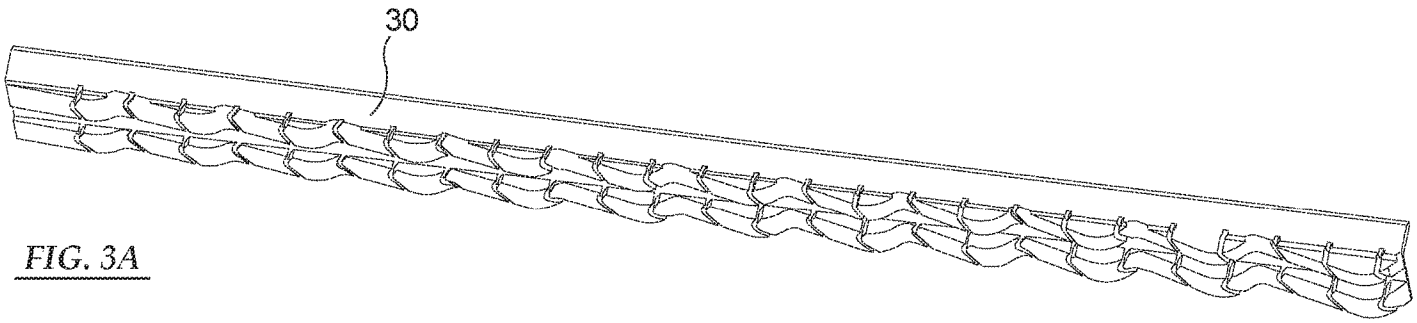
FIG. 3A is a perspective view of an additional thread pattern embodiment of the present invention.
Figure 3B:
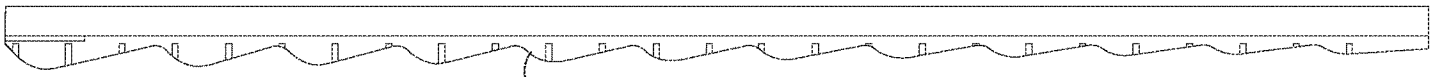
FIG. 3B is a profile view thereof.
Figure 3C:
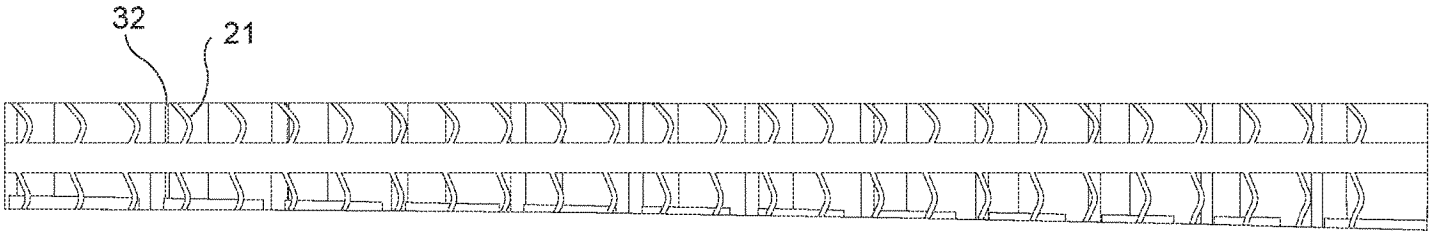
FIG. 3C is a top view thereof which would also correspond to a bottom view of a ski.

Subsequent illustrations, FIG. 3A, FIG. 3B, FIG. 3C show a third traction embodiment 30 with varying profile wave 41 patterns. More specifically regarding FIG. 3B as contrasted with FIG. 4B, peaks 41*a* are taller toward a tail of the ski and tapering to relatively smaller peaks at a tip of the ski therefore providing traction as weight shifts back during a glide stroke. Therefore also, the traction design 41, 41*a* is useful for traversing downhill as well. FIG. 4A, FIG. 4B and FIG. 4C illustrate a fourth tread pattern 40 with peaks 41*a* designed for biting snow. Peaks 41*a* are specifically designed to glide forward grip back. An optimum grip to glide ratio can be fine tuned herein by varying the slope of peaks and/or a slope of the taper (FIG. 3B).

Figure 5D:
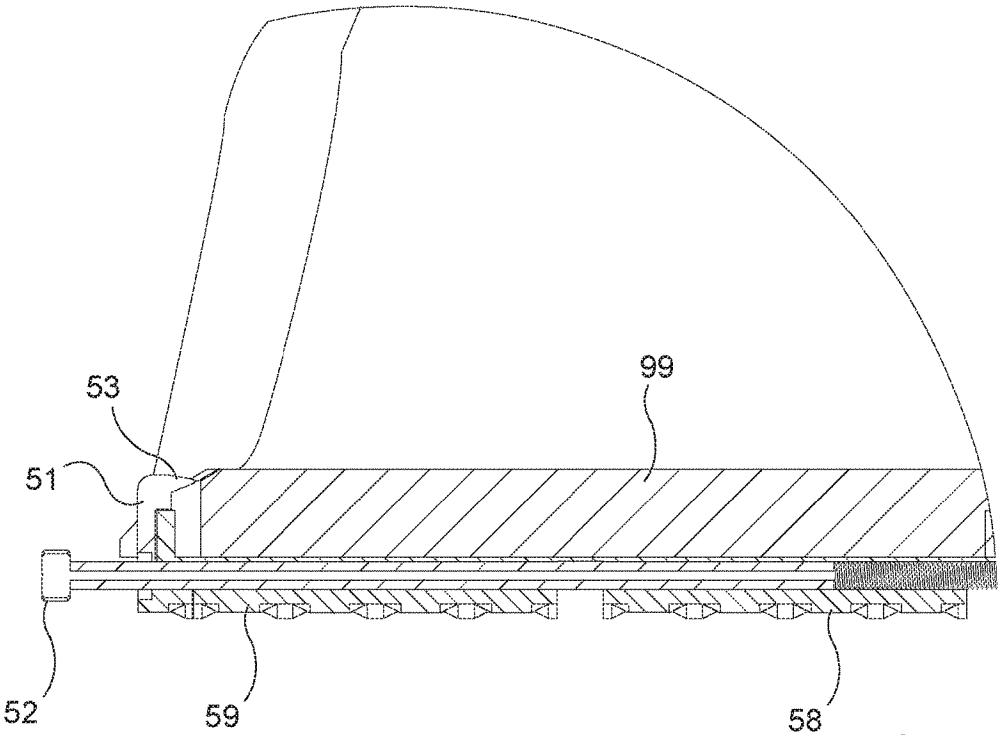
FIG. 5D is a partial cross-sectional view taken along line 5D-5D in FIG. 5C.
Figure 5C:
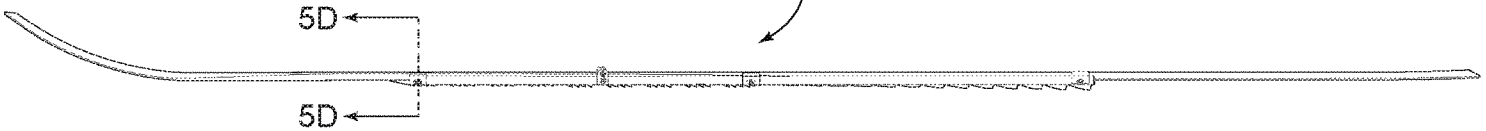
FIG. 5C is a profile view of the clamping system.

With regard to FIG. 5A, FIG. 5B, FIG. 5C and FIG. 5D, a unique securing and fastening system 50 is provided securing traction pads 58 and 59. The system 50 employs left and right side 51 clamp portions. It should be appreciated that the left side clamp would be identical to the right side 51. A fastening rod 52 may be threaded throughout most of its length, or simply threaded at one end to tighten and secure left and right 51 clamp portions together therefore securing traction pads 58, 59 sandwiched in-between. Importantly the clamp portion has a protruding ridge 53 that mates to a slanted side edged surface of the ski 99. Last but not least to this embodiment 50, the clamp portions 51 have a replaceable wear surface 54 that rests between the clamp portion 51 and the side of the ski 99. As seen in FIG. 5D, the protruding ridge 53 could be defined as a tooth portion in the side aspect.

It should be understood, of course, that the foregoing relates to exemplary embodiments of the invention and that modifications may be made without departing from the spirit and scope of the invention as set forth in the following claims.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Accessory Traction Device for Skis herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

While the particular as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A traction device for a ski comprising:

an elongated body about a longitudinal axis, configurable to a bottom of a ski; and an attachment mechanism for coupling the elongated body to the ski, the attachment mechanism comprising:

a right clamp portion configured to a right edge of the ski;

a left clamp portion configured to a left edge of the ski;

a fastening rod having threads around and outside thereof connected beginning at the left portion and extending the width of the ski to the right clamp portion; and a protruding ridge configured to the right clamp portion for mating to a slanted surface of the right edge; and a replaceable wear insert made of a different material than the right clamp portion and configured between the right clamp portion and the right edge of the ski.

2. A traction device for a ski comprising:

an elongated body about a longitudinal axis, configurable to a bottom of a ski, the body having a length; and a hinge configured at a half way point along the length, the hinge providing for the elongated body to fold upon itself and conveniently fit into a backpack, the elongated body comprising two lengthwise strips, the two lengthwise strips comprising left and right articulating portions that articulate about the hinge; wherein the left and the right articulating portions articulate about a pin, wherein the hinge is a sliding hinge and wherein the pin is an adjustment pin wherein the left and the right articulating portions can translate with respect to one another, further wherein the adjustment pin and sliding hinge provide for the two lengthwise strips to move toward one another or away from one another.

3. The traction device configurable to a bottom of a ski of claim 2, the elongated body further comprising a length, the length being thirty-six inches wherein the length is optimally chosen for proper traction functionality, but however such that one half of said length, eighteen inches is sufficiently short to conveniently fit into a backpack, the backpack to be worn on a user's back.

* * * * *